United States Patent [19]

Smith et al.

[11] Patent Number: 4,641,569

[45] Date of Patent: Feb. 10, 1987

[54] CALENDER SELF-LOCKING LOADING MECHANISM

[75] Inventors: Rodney M. Smith; Jiri Masek, both of Montreal, Canada

[73] Assignee: Valmet-Dominion Inc., Lachine, Canada

[21] Appl. No.: 720,244

[22] Filed: Apr. 5, 1985

[30] Foreign Application Priority Data

Apr. 12, 1984 [CA] Canada ..... 451888

[51] Int. Cl.[4] ..... F01B 19/00; B30B 3/04

[52] U.S. Cl. ..... 92/43; 100/170; 100/163

[58] Field of Search ..... 92/43, 37, 76, 140; 100/170, 168, 171, 163

[56] References Cited

U.S. PATENT DOCUMENTS 3,158,088 11/1964 Seidel ..... 100/170
3,270,664 9/1966 Veneman et al. ..... 100/170 X
3,598,041 8/1971 DeNoyer ..... 100/170 X
3,978,784 9/1976 Bryce et al. .

FOREIGN PATENT DOCUMENTS 1032000 5/1978 Canada .

*Primary Examiner*—Larry Jones
*Attorney, Agent, or Firm*—Raymond A. Eckersley

[57] ABSTRACT

An improved pressure actuator particularly suited to loading of rolls in the calender stack is disclosed. The actuator is formed by a pair of spaced arms interconnected by a link. A pressure absorbing locking bar is interposed between a pair of adjacent ends of the arm and a pressure actuator is interposed between the arms of the opposite side of the link. The link itself is pivoted to the frame so that movement of the link around its pivot point on the frame causes the arms to move so that one arm moves into an active position and the other into a reactive or pressure applying position and vice versa. In the reactive position, a locking member on a pressure plate that engages the locking bar locks the arm in reactive position in position so that pressure applied by the actuator between the opposite ends forces the other arm to pivot around its pivotal connection to the link, thereby applying pressure to a load in one direction.

3 Claims, 3 Drawing Figures

CALENDER SELF-LOCKING LOADING MECHANISM

BACKGROUND OF THE INVENTION

The present invention relates to a power system adapted to be selectively operable in two opposite directions. More specifically, the present invention relates to an activator mechanism specially adapted for use in adjusting pressures in a calender stack.

BACKGROUND OF THE INVENTION

The use of air bags as actuators for applying pressure to individual rolls of a stack of calender rolls is well known in the art. A particular application of such an air bag is disclosed in Canadian Pat. No. 1,032,000, issued May 30, 1978 to Bryce et al. It uses an air bag to apply pressure between a pair of adjacent ends of arms. The arms are movable in opposite directions so that one arm is in a reactive position and the other arm is in an active position.

The arrangement disclosed in this patent necessitates incorporation of specific abuttments against which the arms are forced when pressure is applied to the pneumatic actuator. By necessity, these abuttments project rearwardly from the support member supporting the actuator arms and inherently required a significant amount of space thereby limiting the minimum roll diameter of the calenders, i.e., the abuttments surfaces are positioned above and below the actuator so that they contact the top of the upper arm and the bottom of the lower arm, there generally being two abuttments for each arm, one operative when its respective arm is in the reactive position and the other operative when the respective arm is in the active position.

It will be apparent that the requirement for several abuttments for each arm, and the fact that the abuttments must absorb a significant amount of the force applied resulted in a relatively heavy structure that added significantly to the cost of the unit.

BRIEF DESCRIPTION OF THE PRESENT INVENTION

It is an object of the present invention to provide an inexpensive actuator mechanism that can be accommodated in a limited vertical space.

The present invention comprises a pressure activator selectively operable to provide an output force in the selected one of two substantially opposite directions comprising first and second arms interconnected by a link member pivotably connected adjacent each of its ends to one of said arms and to the frame of the machine at a point substantially midway intermediate the pivotal connection of said link to said arms;

a pressure pad on each of said arms adjacent the ends of said arms on one side of the pivotal connections and an extendable actuator interposed between said arm on the opposite side of said pivotal connection;

said pressure pads facing each other and being formed with locking means;

a locking bar connected to said frame and interposed between said arms in a position to be engaged by each of said pressure pads when its respective arm is in a reacting position;

cooperating locking means on said locking bar to cooperate with said locking means of said pressure pad when said pressure pads are in reactive position;

means for moving said arms between a first position wherein said first arm is in a reactive position and said second arm is in an active position and a second position wherein said first arm is in a active position and said second arm is in a reactive position;

said link acting to hold the respective arm in active or reactive positions wherein said arm functions with said stop on said arm in reactive position to fix the location of said arm and with said arm in active position to permit said arm to pivot relative to said link to move said pad and apply pressure to a load.

BRIEF DESCRIPTION OF THE DRAWINGS

Further features, objects and advantages will be evident from the following detailed description of the preferred embodiment of the present invention taken in conjunction with the accompanying drawings in which.

DESCRIPTION OF THE PREFERRED EMBODIMENTS

Figure 1:
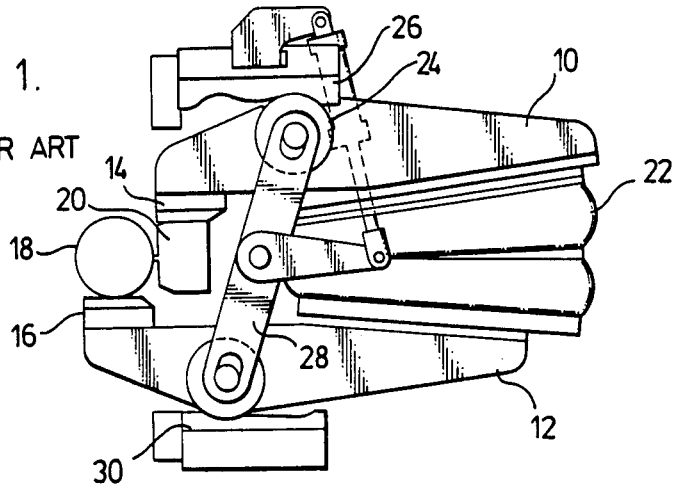
FIG. 1. PRIOR ART
FIG. 1 is a side elevation with parts omitted, of one form of prior art actuator mechanism.

FIG. 1 shows an actuator constructed in accordance with the prior art, namely in accordance with teachings of the said Canadian Pat. No. 1,032,000. In this particular arrangement the two arms 10 and 12 have pressure pads 14 and 16 which are adapted to cooperate with the load 18 or the fixed pressure bar 20. In the illustrated arrangement the arm 10 is in reactive position and is forced by the pneumatic actuator 22 to move the roller 24 mounted on the arm 10 into engagement with a notch in the resisting cam member 26. It will be apparent that the support for the member 26 must be relatively strong since it must resist the pressure applied to the arm 10 (relative cam) which forces the roller 24 against the cam 26 and its pad 14 against the bar 20. In this case the link 28 does not transmit any forces during operation. The opposite arm 12 (active arm) is pivoted on the cam in cam member 30 to move the pressure pad 16 against the load 18.

In another embodiment in the same patent, the resisting cams 26 and 30 are replaced by stop members positioned adjacent top and bottom the arms 10 and 12 respectively adjacent their ends located in contact with the pressure actuator 22. The upper and lower surfaces respectively of the arm 10 and 12 are stepped so that they can function in the reactive sense or the active sense. This particular embodiment is called to attention simply because the bar 20 is eliminated and a link similar to the link 28 is used to resist the forces applied to the arm in the reactive position and permit pivoting movement of the arm in the active position around its pivotal connection to the link similar to link 28.

It will be apparent that in the above cases pressure surfaces are provided above and below the arms 10 and 12 thereby occupying space. In the second embodiment discussed above the position of the stop members are spaced significantly from the front of the unit as determined by the location of the load 18 or bar 20 so that the size of the supporting frame must be increased significantly to accommodate this location for the stops.

Figure 2:
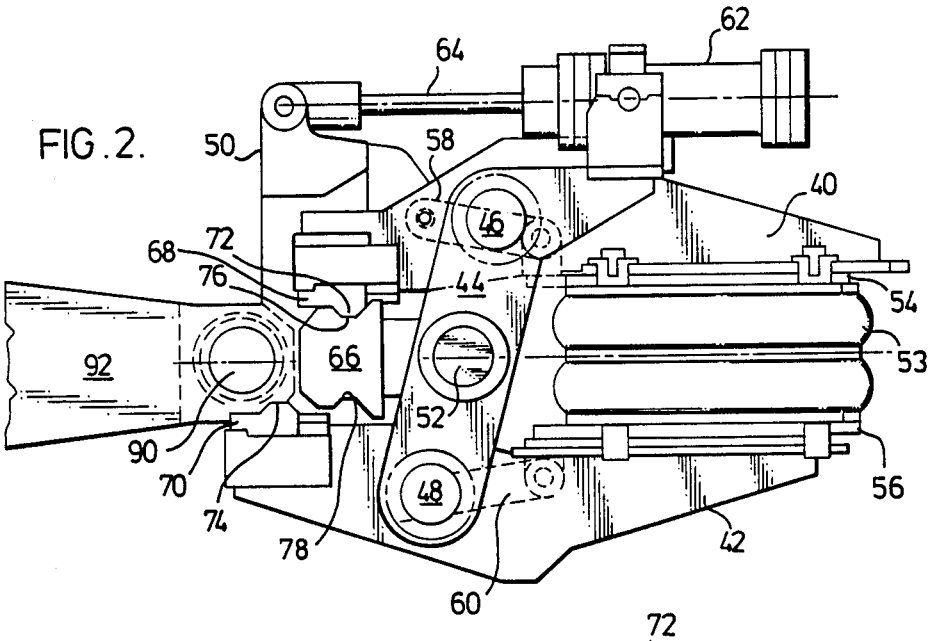
FIG. 2 is a similar view of an actuator constructed in accordance with the present invention.

Referring now to FIG. 2 which discloses the present invention it will be apparent that the arms 40 and 42 are similar to the arms 10 and 12. These arms 40 and 42 are interconnected by a link 44 which is a relative strong link (two links may be provided, one on each side of the arms 40 and 42 or a single link may be used with arms 40 and 42 that are bifuricated to pass on opposite sides of the link 44).

The link 44 is pivotably connected by a pivot pin 46 to the arm 40, via pivot pin 48 to the arm 42 and is itself pivotably connected to the frame generally indicated at 50 via the pivot pin 52. It will be apparent that the link 44 provides a relatively rigid interconnection between the arms 40 and 42 that permits pivoting of the link 44 relative to the frame 50 and pivoting of the arms 40 and 42 relative to the link 44.

At the rearward ends of the arms 42 there are provided platforms 54 and 56 respectively, that are slidably mounted relative to the arms 40 and 42, respectively, so that as the arms are moved between their reactive position (the arm 40 in FIG. 2) and the active position (arm 42) the platform 54 and 56 remain substantially fixed in relation to the frame, i.e., they are interconnected to the frame via links 58 and 60 shown in hidden lines in the figure. (Obviously the sliding pin mountings of these platforms 54 and 56 would not be visable, but have been shown in the illustration to clearly indicate their existance). Such structures were also used in the prior art. A pneumatic actuator 53 is interposed between the platforms 54 and 56.

A shifter, generally a hydraulic cylinder or a pneumatic cylinder, is indicated at 62 reacts with the frame 50, i.e., is interconnected thereto via the piston rod 64 and moves the arms 40 and 42 between their respective active and reactive positions.

Adjacent the front of the actuator is a locking bar 66 that is fixed to the machine and extends transversely between the adjacent ends of the arms 40 and 42. Each of these adjacent ends is provided with a pressure pad 68 and 70, respectively, that is contoured to provide a male element or projection 72 and 74 adapted to be received in the mating aperture 76 or 78 formed in the locking bar 66.

Figure 3:
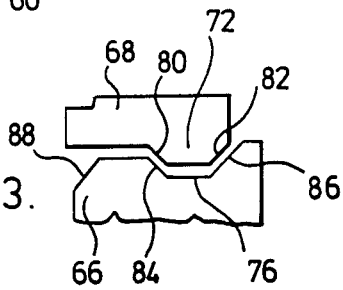
FIG. 3 is an enlarged view of one of the pressure pads and a cooperating surface of the locking bar.

Each of the projections 72 and 74 has a leading face 80 and a trailing face 82 (see FIG. 3) which in the illustrated embodiment are sloped relative to the direction of movement of its respective arm 40 and 42 (only the projector 72 and its cooperating aperture or groove 76 have been shown in FIG. 3 but similar surfaces will be provided on projection 74 and aperture 78) and the cooperating end walls of apertures 76 and 78 are similarly sloped as indicated at 84 and 86 respectively. The surfaces 80 and 84 cooperate to cam the projection 72 (74) out of the aperture 76 (78) when the arm 40 (42) is moved to active position by the piston and cylinder 62, 64 and the surface 82 cooperates with the bevelled surface 88 on bar 66 to move the pad 68 (70) so that movement toward the reactive position by the piston and cylinder 62, 64 is not impeded.

At least a portion of faces 82 and 86 should mate (be in face to face contact) when the projection 72 is received in the aperture or groove 76. These faces need not be sloped as indicated e.g., the face 82 may be substantially perpendicular to the bottom face of the projection 72.

The slope of faces 80 and 84 is important and is chosen such that the horizontal component of the force normal (perpendicular) to these surfaces will keep the reactive arm and thus the link 44 in the desired position when the projection 72 is seated in the aperture or groove 76. The forces applied to link 44 and pivots 46 and 48 by inflation of the bags 53 tend to align the link 44 vertically which would move the actuator into a neutral position, i.e., neither operating position. The resultant force vector between the locking bar (66) and the pressure pad of the reactive arms (40, 42) is determined by determining the force balance for the active arm (40, 42), the link 44 and the reactive arm (40, 42). Thus the surfaces 80 and 84 are preferably sloped to be normal (perpendicular) to this calculated force vector thereby locking the actuator in the selected operative position. It is preferred to set the slope of the faces 80 and 84 perpendicular to the resultant force vector since this will insure locking of the arm in position while permitting easy shifting by the piston and cylinder 62, 64 when the pressure in the bags 53 is released. Obviously as long as the angle between the faces 80 and 84 and the resultant force vector does not result in a sufficiently large force component moving the projection 72 out of the aperture or groove 76 the arm will be locked in reactive position, however care should also be taken to ensure the angle between the faces 80 and 84 and the resultant force vector does not make shifting between active and reactive positions too difficult.

It will be apparent that the arm 40, which is illustrated in reactive position has its pressure pad 68 bearing against the upper surface of the locking bar 66 and its projection 72 received in the mating aperture 76 in the bar 66. The pressure pad 70 of the arm 42 is in an advanced position under the load element 90 which is connection to an arm 92 which in turn will be connected in the conventional manner to a calender roll so that movement of the member 90 will tend to move the arm 92 thereby adjusting the pressure applied to the calender roll.

In operation with the arms 40 and 42 in the position shown in FIG. 2, the pneumatic actuator 53 may be inflated which will tend to pivot the arm 40 about the pivot point 46 and lock the projection 72 into the mating apertures 76 in the bar 66 thereby locking the arm 40 in the position illustrated. The active arm 42 on the other hand, will tend to be pivoted about the pivot point 48 thereby moving the pressure pad 70 in an upward direction tending to move the load element 90 upwardly applying pressure via the arm 92.

By actuating the piston in cylinder 62, 64 the relative positions of the arms 40 and 42 may be changed so that the arm 42 is moved rearwardly, i.e., to the right in FIG. 2, and the arm 40 forwardly, i.e., to the left in FIG. 2, so that the pad 68 overlies the load member 90 and the pad 70 engages the locking bar 66 and the male projection 74 is received within the aperture 78 thereby locking the arm 42 in the reactive position in the same manner as the arm 40 is locked in the illustrated arrangement.

It will be apparent in these arrangements the link 44 must be relatively strong because it is carrying the forces applied by the pneumatic actuator 53.

Having described the invention, modifications will be evident to those skilled in the art without departing from the spirit of the invention as defined in the appended claims.

What we claim as new and desire to secure by Letters Patent of the United States is:

1. Pressure actuator selectively operative to provide force output in a selected one of two substantially opposite directions comprising a frame, a first and second arms, a link means pivotably connected at each of its opposite ends to one of said arms, means pivotably mounting said link means to said frame at a point substantially midway between the pivotal connections of said link with said arms, a pair of opposed pressure pads mounted one on each of said arms on one side of said link and an extensible actuator interposed between said arms on the opposite side of said link to said pressure pads, each of said pressure pads being formed with a locking means, a locking bar interposed between said arms on said one side of said link in a position to be engaged by each of said pressure pads when its respective arm is in a reactive position, cooperating locking means on said locking bar to cooperate with said locking means on said pressure pads when said pressure pads are in reactive position, means for moving said arms by pivoting of said link about its pivotal mounting on said frame thereby to move said arms between a position wherein the first arm is in a reactive position and said second arm is in an active position and a second position wherein said first arm is in an active position and the second arm is in a reactive position, said locking means on each of said pads engaging with its said cooperating locking means on said locking bar when its respective arm is, so that forces applied by said pad in reactive position against its cooperating locking means lock said arm in said reactive position in said reactive position and operating on said locking bar to prevent movement of the said arm in said reactive position, said pivotal connection between said link and said arm in said active position permitting said arm in said active position to pivot and thereby apply a pressure via its pressure pad against a load when said extensible actuator is actuated.

2. An actuator as defined in claim 1 wherein said locking means on each of said pads comprises a male projection extending from the face thereof facing toward the other of said pads and wherein said cooperating locking means comprises mating apertures on the faces of said locking bar facing each of said pressure pads and adapted to receive said male projections.

3. An actuator as defined in claim 2 wherein projections including faces which are said male members remote from said link and which are sloped to be substantially perpendicular to a resultant vector of said forces when said arms are in said reactive position.

* * * * *